United States Patent [19]

Beynon

[11] 4,016,701

[45] Apr. 12, 1977

[54] CONTROLLED EXPANSION SUSPENDED CEILING GRID MEMBER

[75] Inventor: John O. Beynon, Waterloo, Canada

[73] Assignee: Ceiling and Drywall Products Limited, Waterloo, Canada

[22] Filed: Nov. 24, 1975

[21] Appl. No.: 634,643

[30] Foreign Application Priority Data

Nov. 18, 1975 Canada ..... 239918

[52] U.S. Cl. ..... 52/735; 52/DIG. 5; 52/573

[51] Int. Cl.[2] ..... E04C 3/30; E04B 1/68

[58] Field of Search ..... 52/735, 232, 484, 573, 52/DIG. 5, 664; 287/189.36 A

[56] References Cited

UNITED STATES PATENTS

| | | | |
|---|---|---|---|
| 3,175,655 | 3/1965 | Brown et al. | 52/DIG. 5 |
| 3,189,139 | 6/1965 | Znamirowski et al. | 52/DIG. 5 |
| 3,221,846 | 12/1965 | Brown et al. | 52/DIG. 5 |
| 3,778,947 | 12/1973 | Sauer | 52/DIG. 5 X |
| 3,807,111 | 4/1974 | Brady | 52/573 |
| 3,846,031 | 11/1974 | Adams | 52/573 |

FOREIGN PATENTS OR APPLICATIONS

| | | | |
|---|---|---|---|
| 848,115 | 8/1970 | Canada | 52/DIG. 5 |

*Primary Examiner*—Price C. Faw, Jr.
*Assistant Examiner*—Robert C. Farber

[57] ABSTRACT

A controlled expansion suspended ceiling grid member for suspended panel or tile ceilings comprises a web having a panel supporting flange provided along one of its marginal edges and a bead integral with the other marginal edge. The bead side walls are unconnected at the bead's base. An expansion accommodating portion is provided for accommodating thermal expansion in the beam and comprises three evenly spaced apart notches cut in the web in a manner which adapts the flange to fold downwardly away from the bead during beam expansion. The bead's top wall has slot means cut therein to essentially free the bead's side walls from transverse connection to adapt the side walls to buckle laterally out of their respective planes as the flange is folded so that the bead remains substantially horizontal and distortion along the beam's length is minimized.

23 Claims, 4 Drawing Figures

CONTROLLED EXPANSION SUSPENDED CEILING GRID MEMBER

FIELD OF THE INVENTION

This invention relates to controlled expansion suspended ceiling grid members or beams used in suspended panel ceilings having an expansion accommodating portion for localizing and controlling thermal expansion in and thereby minimizing distortion along the member due to exposure of the member to extremely high temperatures.

BACKGROUND OF THE INVENTION

A structural member or beam used in suspended panel ceilings which is held fast as its ends expands when subjected to the heat of a fire, and buckles and distorts along its length if there is no provision in the beam for accommodating thermal expansion therein in a controlled manner. This distortion in the structural beam results in dropping of the ceiling panels from the suspended ceiling. Ceiling panels for suspension ceilings can be fabricated from material to act as a fire spreading retardant when in position so that the suspended panels should be retained in the ceiling as long as possible during a fire. An expansion accommodating portion may be provided in a suspension ceiling structural beam to accommodate thermal expansion in the beam in a controlled manner so that distortion along the beam's length is minimized, thereby retaining the panels in the suspended ceiling for a longer length of time to retard the spread of fire.

U.S. Pat. No. 3,388,519 discloses an expansion accommodating structural beam for suspended ceilings. The structural strength of the disclosed beam is substantially weakened by the provision of a slot extending transversely through the beam's bead. The thusly severed bead portions must bypass one another as the web is torn along perforations therein during thermal expansion in the beam. As the severed bead portions bypass one another, the flange during its bending is distorted laterally to form a zig-zag in the beam which may permit the ceiling panels to fall from the suspended ceiling.

It is therefore an object of the invention to provide an expansion accommodating portion providing for controlled thermal expansion at a predetermined location in a suspended ceiling grid beam to substantially maintain beam alignment during thermal expansion with a minimum effect on the structural strength of the beam.

It is another object of the invention to provide a suspended ceiling grid beam which has provision for controlling thermal expansion in the beam in a manner which minimizes distortion along the beam and in the ceiling grid system of such beams so that the suspended ceiling panels are retained in the ceiling grid system for an extended period during a fire.

It is yet another object of the invention to provide a suspended ceiling grid beam wherein the side walls of the beam's bead in the locale of the expansion accommodating portion are essentially freed from transverse connection at their top and bottom over a significant length to adapt the bead side walls to buckle laterally out of their respective planes as the expansion accommodating portion takes up the thermal expansion.

It is a further object of the invention to provide a suspended ceiling grid beam wherein with the bead side walls unconnected at the bead's base, means is provided to initiate buckling of the bead side walls at a predetermined location so that the bead side walls buckle laterally out of their respective planes as the flange is folded during thermal expansion in the beam.

BRIEF SUMMARY OF THE INVENTION

A controlled expansion suspended ceiling grid member or beam for suspended panel or tile ceilings having an expansion accommodating portion according to this invention accommodates thermal expansion in a controlled manner in the beam with minimal distortion along the beam's length so that the ceiling panels or tiles are retained in the ceiling to retard the spread of fire until the ceiling suspension system collapses. The controlled expansion suspended ceiling grid beam comprises a web having spaced-apart marginal edges, a flange having a panel supporting surface provided along one of the marginal edges, a bead provided along the other of the marginal edges and an expansion accommodating portion for accommodating and localizing thermal expansion at a predetermined location. The bead has substantially planar spaced-apart side walls with an interconnecting substantially planar top wall. The bead side walls are unconnected from each other at the bead's base. The expansion accommodating portion comprises three substantially evenly spaced-apart flange deflecting directing notches cut in the web. The portion of the web above the notches is severed in a manner to provide a web severance bridging the upper ends of the notches which leaves a first strip of the web extending along and beneath the bead's base. The three notches permit the flange to bend in the area of each notch lower end whereby the flange is adapted to fold downwardly away from the bead to accommodate thermal expansion in the beam.

The bead's top wall has slot means cut therein. The slot means essentially frees the bead's side walls from transverse connection over the slot means' length to adapt the side walls to buckle laterally out of their respective planes as the flange is folded so that the bead remains substantially horizontal. The lower end of each notch is located at least near to the plane defined by the panel supporting surface of the flange. In a preferred embodiment, a second strip of the web extends along between the plane of the panel supporting surface and the lower ends of the notches.

The portion of the web above the notches may be severed in a manner to remove from the web a cut-out portion, the perimeter of which defines an opening bridging the upper ends of the notches and defines the lower edge of the first strip of the web.

Means may be provided in the first strip of web for weakening it below the slot means to facilitate and locate the area of initial buckling of the bead side walls and the first strip of web.

Unlike the structural beam of U.S. Pat. No. 3,388,519, the expansion accommodating portion of the suspended ceiling grid beam according to this invention has minimal effect on the beam's structural strength because the beam's bead side walls are essentially continuous. There is no need for perforations in the web of this invention which extend along beneath the bead because unlike the structural beam of U.S. Pat. No. 3,388,519, the bead side walls buckle laterally out of their respective planes without requiring a shearing of the web portion. As a result, the buckling of the bead side walls according to this invention does not induce a zig-zag distortion in the flange as it bends so that beam alignment is substantially maintained during thermal expansion in the beam.

DESCRIPTION OF THE DRAWINGS

These and other objects, advantages and features of the invention will become apparent in the following detailed description of the preferred embodiments of the invention as shown in the drawings wherein.

DETAILED DESCRIPTION OF THE PREFERRED EMBODIMENTS

Figure 1:
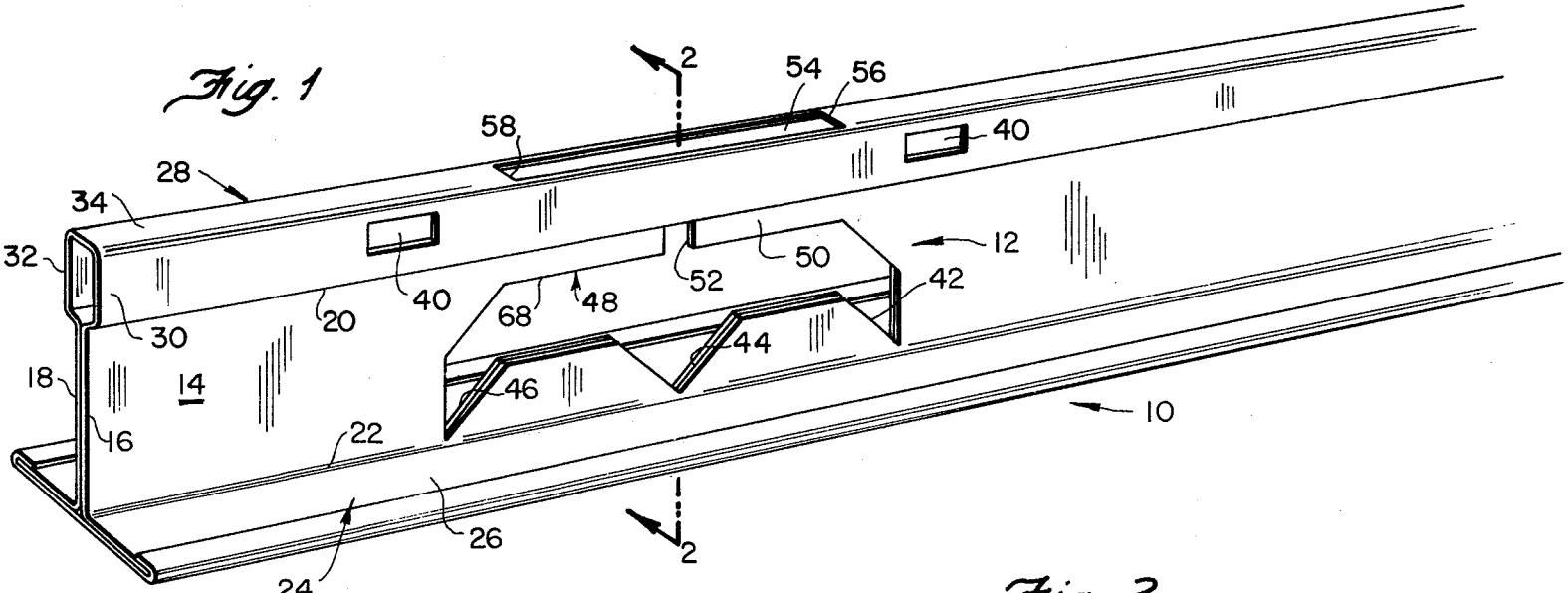
FIG. 1 is a perspective view of a structural beam according to this invention having a collapsible portion therein.

Referring to FIG. 1 of the drawings, a suspended ceiling grid member or beam 10 for use in a suspended panel ceiling grid system is shown with an expansion accommodating portion generally designated at 12 for localizing and controlling thermal expansion in the beam to minimize distortion along the beam's length and thereby substantially maintain beam alignment when the extremities of the beam are held fast and it is exposed to the heat of a fire. The structural beam 10 comprises a double walled web 14 having web walls 16 and 18 with spaced-apart marginal edges 20 and 22. A flange 24 havinga panel supporting surface 26 is integrally formed with the web double walls at marginal edge 22 as more clearly shown in FIG. 3. A cap 25, rolled over flange legs 27, retains the legs together and provides a finished appearance on the underside of the beam which is exposed in the suspended ceiling grid system.

Bead 28 is integrally formed with the double walls of web 14 at its base which corresponds with marginal edge 20. Bead 28 has substantially planar side walls 30 and 32 interconnected by a substantially planar top wall 34. At the base of bead 28, the sides 30 and 32 are bent inwardly to form undercuts 36 and 38 which are integral with respective web walls 16 and 18. As more clearly shown in FIG. 3, the side walls 30 and 32 are unconnected at the bead's base along marginal edge 20. The side walls 30 and 32 are continuous at least along the upper and lower bead portions 37 and 39 where openings 40 may be cut in the bead side walls at intervals along the bead. Wire or other like beam hanging device may be passed through openings 40 for purposes of suspending the beam from a concrete ceiling or the like. Since the side walls are continuous above and below the openings 40, such openings have a minimum effect on the structural strength of the bead side walls in carrying vertical loads applied to the beam flange. It is, of course, understood that openings 40 are not considered to be part of the expansion accommodating portion 12 of the beam.

Although with a preferred embodiment shown in the drawings, the suspended ceiling grid beam has a double walled web, it is understood that the web of the beam may be a single wall. The expansion accommodating portion according to this invention is readily used in a single walled web where the bead side walls of the beam are unconnected from each other at the base of the bead. For example, with such an arrangement only one of the bead side walls may be integral with a beam's single web wall, the other bead side wall being bent inwardly towards the opposing bead side wall at the bead's base, but not connected to the opposing bead side wall.

The expansion accommodating portion 12 as shown in FIG. 1 includes three substantially evenly spaced-apart V-shaped notches 42, 44 and 46. The portion of web 14 above notches 42, 44 and 46 is severed in a manner to remove from the web 14 a cut-out portion, the boundary of which defines an opening 48 which bridges the upper ends of notches 42, 44 and 46. The cut-out or opening 48 leaves a strip 50 of the web beneath the base of bead 28. The strip 50 has a notch 52 cut therein which opens into opening 48. The notch 52 extends upwardly towards the base of bead 28 to undercut portions 36 and 39 as more clearly shown in FIG. 3.

The periphery of opening 48 includes the lower edge 68 of strip 50 and angularly disposed edges 70 and 72. Between notches 42 and 46 is a web portion 74 and between notches 44 and 46 is web portion 76. It is understood that the shape of cutout portion 48 may be varied from the shape shown in FIG. 2 and, for that matter, the web 14 may be severed in a way which defines a severance in the web extending from the upper end of notch 46 over to the upper end of notch 42 so as to bridge the upper ends of notches 42, 44 and 46. In this type of arrangement, the web above the notches may be weakened by a notch such as notch 52 or by other means such as perforations which would extend upwardly from the slit bridging the notches towards the bead's base 20. The notch or perforations would locate the area of initial buckling of the bead side walls and the strip of the web above the notches.

Figure 3:
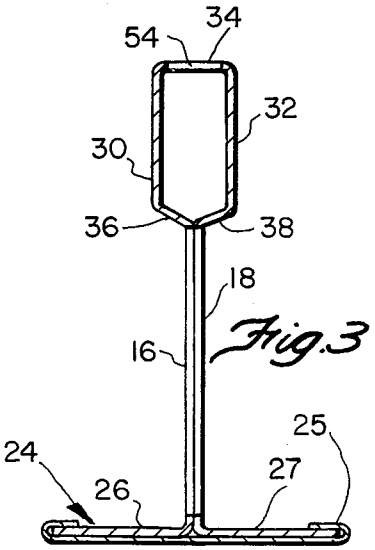
FIG. 3 is a section of the portion of the beam shown in FIG. 2 taken along the lines 3—3 where both sides of the beam are shown in FIG. 3.

The top wall 34 of the bead has a slot means in the form of an elongate rectangular slot 54 cut therein. The slot is of significant width and is substantially centrally located over the middle notch 44 with the edges 56 and 58 of the slot being adjacent points above the outer notches 42 and 46. Referring to FIG. 3, slot 54 frees bead side walls 30 and 32 from transverse connection over the entire length of slot 54. The width of slot 54 is substantially equal to the width of top wall 34.

It is understood that other shapes for the slot in top wall 34 may be used. The purpose of the slot means is to essentially free the bead side walls from transverse connection over the length of the slot means so that the bead side walls can buckle laterally out of their respective planes because the side walls are also unconnected at the bead's base. An elongated diamond-shaped slot, for example, may be used. The slot means may be cut in a manner which leaves a sliver or slim piece of metal joining the bead side walls together where the sliver or slim piece of metal would readily shear to permit the side walls to buckle during thermal expansion in the beam so that even with this minute connection between the side walls, the slot means serves to essentially free the side walls from transverse connection. For example, when the slot means is formed by cutting the top wall, the resultant slug of metal may not be entirely removed from the thusly formed slot. The slug of metal may still have a sliver of metal joining the slug on each side to the bead side walls. The purpose of retaining the slug of metal in the beam's bead in this mammer is to prevent the slug from rattling around and getting in the way during installation of the beam in a ceiling grid.

Figure 2:
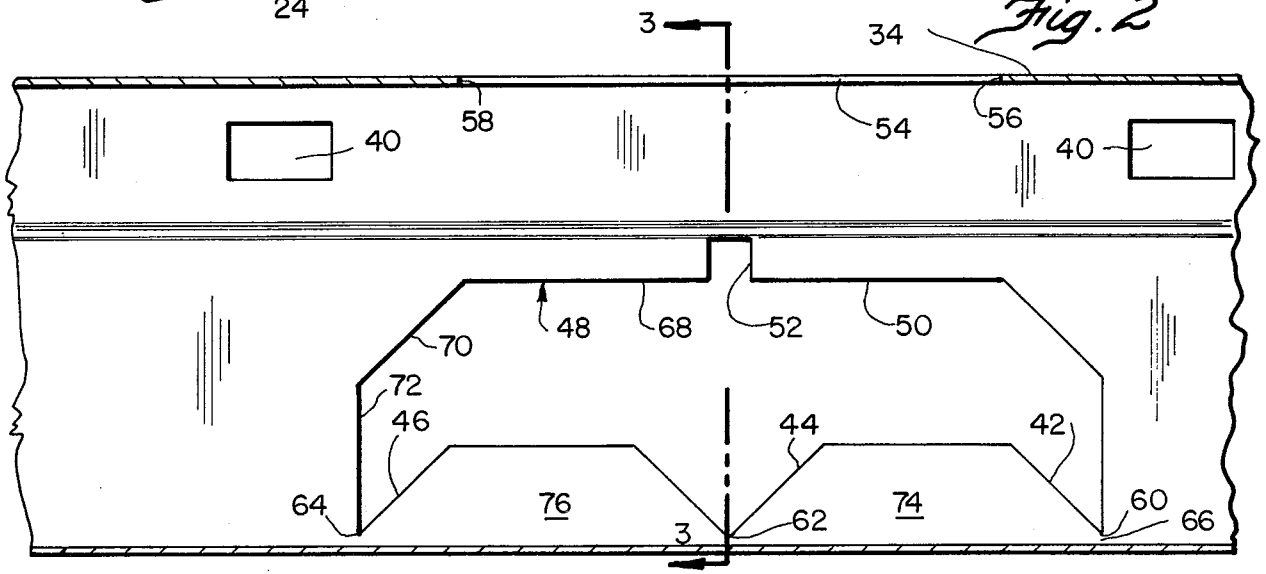
FIG. 2 is a section of the structural beam of FIG. 1 taken along the lines 2—2.

In a preferred embodiment shown in FIG. 2, notches 42, 44 and 46 have apexes 60, 62 and 64 which are located at least near to the plane defined by the panel supporting surface 26 of the flange 24. A strip of the web 66 as shown in FIGS. 2 and 3 is therefore defined by and extends beneath the apexes of notches 42, 44 and 46. It is understood that the apexes of the notches may extend even further downwardly towards the panel supporting surface 26 or extend down to the plane defined by the panel supporting surface 26.

Figure 4:
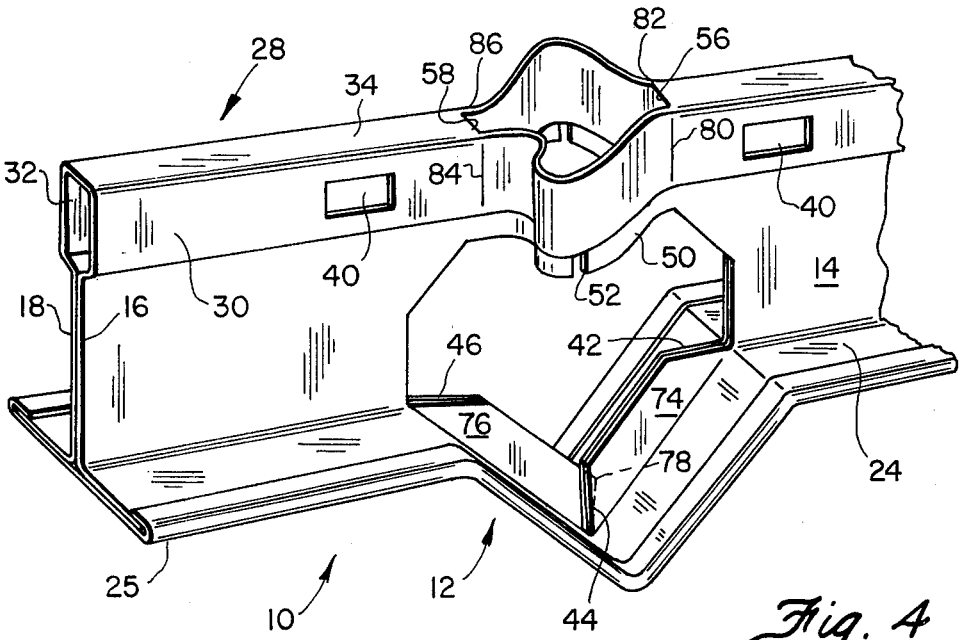
FIG. 4 shows a structural beam of FIG. 1 with the collapsible portion of the beam collapsed during exposure to the heat of a fire.

Turning to FIG. 4, beam 10 having its free ends held fast is shown with an expansion accommodating portion 12 having taken up thermal expansion during the beam's exposure to the heat of a fire to thereby localize and control the thermal expansion in the beam in the area of portion 12. The flange 24 is folded downwardly where notches 42 and 46 have opened and notch 44 has closed, web portion 76 having passed behind web portion 74 as shown by dotted line 78. Opposing edges of notch 44 may be bent away from each other to provide two caming portions which facilitate the passage of web portions 74 and 76 by each other. The apexes of the notches 42, 44 and 46 provide areas of weakness in the flange which permit a transverse bending of the flange in these weakened areas so that the flange is folded downwardly away from bead 28. In a preferred embodiment, the web strip 66 located beneath apexes 60, 62 and 64 of the notches assists in directing the folding of the flange in a downward direction. As can be appreciated, for the flange 24 to fold downwardly, the portion of the strip 66 beneath notch 62 collapses and folds upon itself as the flange folds. On the other hand, if the flange were to fold upwardly with apex 62 travelling towards bead 28, the web strip 66 would have to stretch or perhaps even shear to permit such a movement. Since it is known that the stretching and shearing of sheet metal requires more force than the buckling and folding of the sheet metal upon itself, strip 66 of the web thereby ensures that the flange folds in a downward direction away from bead 28 during thermal expansion in the beam.

As the flange 24 folds downwardly, the bead side walls 30 and 32 buckle laterally outwardly of their respective planes as shown in a representative manner in FIG. 4. Notch 52 located in strip 50 which extends through both web walls 16 and 18 weakens the strip at its location to thereby locate the area of initial buckling of the bead side walls 30 and 32. In this preferred embodiment, notch 52 is centrally located above notch 44 so that the bead side walls 30 and 32 buckle centrally of their length of the slot 54. During the buckling of the side walls 30 and 32, the edges 56 and 58 of the slot 54 move towards one another. The outward buckling of sides 30 and 32 essentially does not have a downward component of movement so that the top wall 34 of the bead remains substantially horizontal during its collapse.

The slot edges 56 and 58 as they extend laterally outwardly to almost each side wall 30 and 32, provide living hinges in the areas designated 80, 82, 84 and 86 so that the bead sides may bend in these areas to facilitate the buckling of the bead sides out of their respective planes between areas 80 and 84, 82 and 86. As a result, the metal of top wall 34 adjacent areas 80, 82, 84 and 86 is not sheared during the buckling of the bead side walls 30 and 32 because most of the top wall is removed in the area of slot 54.

With the provision of the slot means in the top wall of the bead to permit the bead side walls to buckle laterally out of their respective planes, beam alignment along the beam's length is essentially maintained because the expansion accommodating portion permits the beam to telescope along its longitudinal axis. In the preferred embodiment of the invention shown in the drawings, the expansion accommodating portion functions in a manner which does not induce any lateral zig-zag movement in the flange as it folds so that beam alignment is essentially maintained.

It is understood that the first strip of web 50 beneath the bead's base only requires a notch or perforations provided therein to locate the area of initial buckling of the bead side walls. If a notch were not provided in the strip 50, the bead side walls would still buckle during thermal expansion in the beam, only the configuration of the buckle would be somewhat different from that shown in FIG. 4 because the bead side walls may not buckle initially centrally of the slot. A further consideration is that the notch 52 may be located off centre of notch 44 which would in turn encourage the side walls to buckle initially in the area of newly-located notch 52, so that the configuration of the buckled bead side walls after thermal expansion in the beam may be somewhat different from that shown in FIG. 4.

The structural beam 12 may be fabricated from metals commonly used in suspension ceiling beams such as sheet metal which is sufficiently malleable to permit the folding of the flange and the buckling of the bead in the manner shown in FIG. 4.

One or more thermal expansion accommodating portions 12 may be provided in the beam 10, the size of which depends upon the number of them in the beam. For example, in a 12-foot suspended ceiling grid beam of sheet metal, the thermal expansion in the beam is approximately 1⅝ inches at a temperature of 1800° F. If only one expansion accommodating portion is provided in the beam, then it must be adapted to accommodate this thermal expansion of 1⅝ inches. With the embodiment shown in FIG. 1, the minimum distance between edges 56 and 58 of slot 54 would be 1⅝ inches and the distance between apexes of notches 42 and 46 may be equivalent to the length of slot 54 or, as shown in FIG. 1, somewhat longer.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A controlled expansion suspended ceiling grid beam for a suspended panel ceiling comprising a web having spaced-apart marginal edges, a flange having a panel supporting surface provided along one of said marginal edges, a bead being provided along the other of said marginal edges, said bead having substantially planar spaced-apart sidewalls which are continuous at least along the upper and lower bead portions and an interconnecting substantially planar top wall, said bead sidewalls being unconnected at the bead's base and an expansion accommodating portion for accommodating thermal expansion at a predetermined location in said beam comprising three substantially evenly spaced-apart notches cut in the web having lower and upper ends, said lower end of each notch being in the form of an apex and located at least near to the plane defined by the panel supporting surface of the flange, the web above said notches being severed in a manner to provide a web severance bridging the upper ends of said notches which leaves a first strip of the web extending along the bead's base, the bead's top wall having slot means cut therein, said slot means being substantially centrally located over the middle notch of said three notches with said slot means extending to adjacent points above the notches on each side of the middle notch, said three notches permitting said flange to bend in the area of each said notch apex whereby said flange folds downwardly away from said bead to accommodate thermal expansion in said beam, said slot means essentially freeing the bead's sidewalls as they lie in their respective planes from transverse connection over the slot means' length to adapt said side walls to buckle laterally out of their respective planes as said flange is folded, said slot means adapting said bead to collapse and maintain its longitudinal alignment without offsetting the longitudinal alignment of said flange apart from the downwardly folding flange portion.

2. A controlled expansion suspended ceiling grid beam of claim 1 wherein the apex of each notch lower end is near to the plane defined by the panel supporting surface of said flange so that a second strip of web extends beneath the apexes of said notches.

3. A controlled expansion suspended ceiling grid beam of claim 1 wherein means for weakening said first strip is provided therein below said slot means to facilitate buckling of said bead side walls and said first strip of web out of their respective planes.

4. A controlled expansion suspended ceiling grid beam of claim 1 wherein each of said notches is V-shaped.

5. A controlled expansion suspended ceiling grid beam of claim 3 wherein said means for weakening said first strip is a secondary notch cut in and extending upwardly a substantial width of said first strip.

6. A controlled expansion suspended ceiling grid beam of claim 1 wherein said slot means is a substantially rectangular slot which is of a significant width.

7. A controlled expansion suspended ceiling grid beam of claim 5 wherein said slot means ia a rectangular slot which along with said secondary notch are both substantially centrally located above said middle notch.

8. A controlled expansion suspended ceiling grid beam of claim 1 wherein the web above said notches is severed in a manner to remove from the web a cut-out portion the perimeter of which defines an opening bridging the upper ends of said three notches and defines a lower edge of said first strip of web.

9. A controlled expansion suspended ceiling grid beam of claim 8 wherein the apex of each notch lower end is near to the plane defined by the panel supporting surface of said flange so that a second strip of web extends beneath the apexes of said notches.

10. A controlled expansion suspended ceiling grid beam of claim 9 wherein a secondary notch is cut in said first strip which opens into said opening and extends upwardly towards the bead's base, said secondary notch weakening said first strip to facilitate buckling of said bead side walls and said first strip of web.

11. A controlled expansion suspended ceiling grid beam of claim 10 wherein said secondary notch extends up to the bead's base.

12. A controlled expansion suspended ceiling grid beam of claim 10 wherein said slot means is a rectangular slot which along with said secondary notch are both substantially centrally located above said middle notch.

13. A controlled expansion suspended ceiling grid beam of claim 8 wherein the distance between the apexes of the notches on each side of said middle notch is greater than the overall length of said slot means.

14. A controlled expansion suspended ceiling grid beam of claim 8 wherein said slot means is a substantially rectangular slot and of a width which is substantially equal to the width of the bead's top wall.

15. A controlled expansion suspended ceiling grid beam of claim 8 wherein said web is double walled, said bead side walls being bent towards each other at the bead's base and intregrally formed with the double walls of said web so that said side walls are unconnected at the bead's base.

16. A controlled expansion suspended ceiling grid beam of claim 8 wherein a single expansion accommodating portion is provided in a beam, the distance between the two outermost notches being sufficient to accommodate the expected thermal expansion in a beam when such beam is subjected to the high temperatures of a fire where beam alignment is essentially maintained during thermal expansion in the beam.

17. A controlled expansion suspended ceiling grid beam for a suspended panel ceiling comprising a web having spaced-apart marginal edges, a flange having a panel supporting surface provided along one of said marginal edges and a bead provided along the other marginal edge, and an expansion accommodating portion for accommodating thermal expansion at a predetermined location in said beam, said bead having substantially flat spaced-apart sidewalls which lie on opposite sides of the bead axis and which are continuous at least along the upper and lower bead portions and an interconnecting substantially flat top wall, said bead sidewalls being essentially unconnected at the bead's base, said expansion accommodating portion comprising longitudinal slot means cut in the bead's top wall for essentially disconnecting at the top the flat spaced-apart bead sidewalls along the length of the slot means and a cut-out portion in said web beneath said slot means to provide for downward folding of the flange portion beneath said cut-out portion on beam expansion, the arrangement being such that during thermal expansion in said beam as the flange portion beneath said cut-out portion folds downwardly, the spaced apart bead sidewalls by virtue of their being essentially unconnected at the top and bottom and lying on opposite sides of the bead's axis buckle laterally outwardly away from each other to control movement of the bead portions at opposite ends of the slot means to cause said bead portions to move towards each other while maintaining bead and beam alignment and hence flange alignment apart from the downwardly folding flange portion.

18. A controlled expansion suspended ceiling grid beam of claim 17, wherein said cut-out portion comprises three substantially, evenly spaced-apart notches cut in the web having lower and upper ends, said lower end of each notch being in the form of an apex and located at least near to the plane defined by the panel supporting surface of said flange, the web above said notches being severed in a manner to provide a web-severence bridging the uper ends of said notches which leaves a strip of web extending along the bead's base.

19. A controlled expansion suspended ceiling grid beam of claim 18, wherein means for weakening said strip of web is provided below said slot means to facilitate buckling of said bead sidewalls and said strip of web out of their respective planes.

20. A controlled expansion suspended ceiling grid beam of claim 17, wherein said slot means is rectangular in shape.

21. A controlled expansion suspended ceiling grid beam of claim 18, wherein the web above said notches is severed in a manner to remove from the web a cutout portion, the perimeter of which defines an opening bridging the upper ends of said three notches and defines the lower edge of said strip of web.

22. A controlled expansion suspended ceiling grid beam of claim 21, wherein a secondary notch is cut in said strip of web for weakening such web to facilitate buckling of bead sidewalls.

23. A controlled expansion suspended ceiling grid beam of claim 17, wherein said slot means is provided in the bead top wall in a manner to remove essentially the top wall at the ends of the slot means and at a point medial of the slot means' ends so that as said bead collapses said bead sidewalls bend at the ends of the slot means and at said point medial of the slot means.

* * * * *